US006604955B2

(12) United States Patent
Dawson et al.

(10) Patent No.: US 6,604,955 B2
(45) Date of Patent: Aug. 12, 2003

(54) ELECTRONIC CIRCUIT PROTECTION DEVICE

(75) Inventors: David Brian Dawson, Howell, NJ (US); Matthew J. Gawron, Jackson, NJ (US); George Kopacz, Aberdeen, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 10/016,208

(22) Filed: Nov. 2, 2001

(65) Prior Publication Data

US 2003/0087540 A1 May 8, 2003

(51) Int. Cl.[7] ..... H01R 13/53
(52) U.S. Cl. ..... 439/181; 439/79; 439/541.5
(58) Field of Search ..... 439/181, 64, 79, 439/630, 541.5

(56) References Cited

U.S. PATENT DOCUMENTS

| | | | | | |
|---|---|---|---|---|---|
| 5,013,264 | A | | 5/1991 | Tondreault | 439/636 |
| 5,308,251 | A | | 5/1994 | Kaufman et al. | 439/64 |
| 5,357,402 | A | | 10/1994 | Anhalt | 361/753 |
| 5,427,534 | A | * | 6/1995 | Spickler et al. | 439/325 |
| 5,478,246 | A | | 12/1995 | Cheng | 439/64 |
| 5,502,620 | A | | 3/1996 | Funck et al. | 361/737 |
| 5,643,001 | A | * | 7/1997 | Kaufman et al. | 439/159 |
| 5,653,596 | A | | 8/1997 | Banakis et al. | 439/64 |
| 5,688,130 | A | | 11/1997 | Huang | 439/79 |
| 5,716,221 | A | * | 2/1998 | Kantner | 361/737 |
| 5,725,394 | A | | 3/1998 | Banakis et al. | 439/607 |
| 5,747,735 | A | | 5/1998 | Change et al. | 174/51 |
| 5,906,510 | A | * | 5/1999 | Lwee | 439/541.5 |
| 6,053,747 | A | | 4/2000 | Aggus et al. | 439/67 |
| 6,067,234 | A | * | 5/2000 | Kim et al. | 257/679 |
| 6,135,793 | A | | 10/2000 | Babineau | 439/92 |
| 6,146,202 | A | | 11/2000 | Ramey et al. | 439/608 |
| 6,231,391 | B1 | | 5/2001 | Ramey et al. | 439/608 |
| 6,287,143 | B1 | * | 9/2001 | Lwee | 439/159 |

* cited by examiner

*Primary Examiner*—P. Austin Bradley
*Assistant Examiner*—Edwin A. León
(74) *Attorney, Agent, or Firm*—Birch, Stewart, Kolasch & Birch, LLP

(57) ABSTRACT

An electronic circuit protection device includes a first receiving capable of receiving a first connector. The device also includes two pair of resilient contact arms electrically coupled to the first receiving portion. The contact arms are capable of receiving a second connector. The device electronically couples the first connector to the second connector when the first connector and the second connector are inserted into the device. The device provides protection from electrostatic discharge by providing an electrically conductive path to ground, which bypasses components, which may be harmed by resultant potentially harmful currents. In one embodiment, the device is compliant with PCMCIA and JEIDA standards.

18 Claims, 5 Drawing Sheets

ELECTRONIC CIRCUIT PROTECTION DEVICE

FIELD OF THE INVENTION

The invention generally relates to electronic circuit protection, and more specifically to a connector providing electrostatic discharge protection.

BACKGROUND

A common problem often occurring when users interface with electronic circuits and devices, is the build-up of electrical charges on the devices, circuits, and the users themselves. Typically, charges are generated on devices and circuits, such as a circuit card, during handling of the card. When a card bearing charges is inserted into an electronic apparatus or its connector, the charges cause current to flow to the electronic apparatus through the connecting terminals of the connector or through other components of the system. The charges can result in damage to or ultimate failure of the circuits or other circuit elements on the card as well as the electronic apparatus itself.

Consequently, structures have been embodied in IC cards and/or their mating connectors for removing static electrical charges stored in the cards. The card typically is grounded to the electronic apparatus. To facilitate grounding and to provide effective static protection, IC cards have been provided with conductive grounding clips for engaging appropriate ground means on the mating electronic apparatus. In fact, with the recent standardization of memory card-receiving connectors, (such as PCMCIA and JEIDA), the location of the grounding clips on the IC card (and the mating connector) is provided at a fixed location along the outer side edge thereof. Previous designs of grounding clips include stand-alone grounding elements soldered directly to the internal circuit board and coupled directly to one or both covers, and clips fixed on one end to the card frame or formed integrally with a shield or cover for connection to a grounding pad on a bottom surface of the internal circuit board. Each of these designs has drawbacks however. The stand-alone grounding elements tend to be very small components which require fixturing and/or special handling during assembly. The clips fixed to the card frame typically are soldered to a grounding pad on the bottom surface of the internal circuit board. Accordingly, as the board is processed upside-down during soldering, the board must be fixtured to prevent misalignment or disassociation of the board relative to the clip and frame assembly. In some cases, struts on the frame itself can interfere with the soldering. In the case of grounding clips integral with a shield or cover, the stamping and forming of such an element becomes complicated and expensive, particularly since the robust material of the cover also is used to form the resilient grounding clip, thus making the clip particularly susceptible to inelastic deformation. Furthermore, because of the number of components involved in card assembly (i.e. circuit board, frame, receptacle connector, top and bottom covers, etc.), additional components can make the assembly of the memory card increasingly difficult.

SUMMARY OF THE INVENTION

An electronic circuit protection device includes a first receiving portion capable of receiving a first connector. The first receiving portion is approximately conformably shaped to the first connector. The first receiving portion is electrically coupled to the first connector when the first connector is inserted into the first receiving portion. The device also includes a second receiving portion capable of receiving a second connector. The second receiving portion is electrically coupled to the second connector when the second connector is inserted into the second receiving portion. The device electronically couples the first connector to the second connector when the first connector and the second connector are inserted into the device.

BRIEF DESCRIPTION OF THE DRAWINGS

The invention is best understood from the following detailed description when read in connection with the accompanying drawing. The various features of the drawings may not be to scale. Included in the drawing are the following figures.

DETAILED DESCRIPTION

Figure 1:
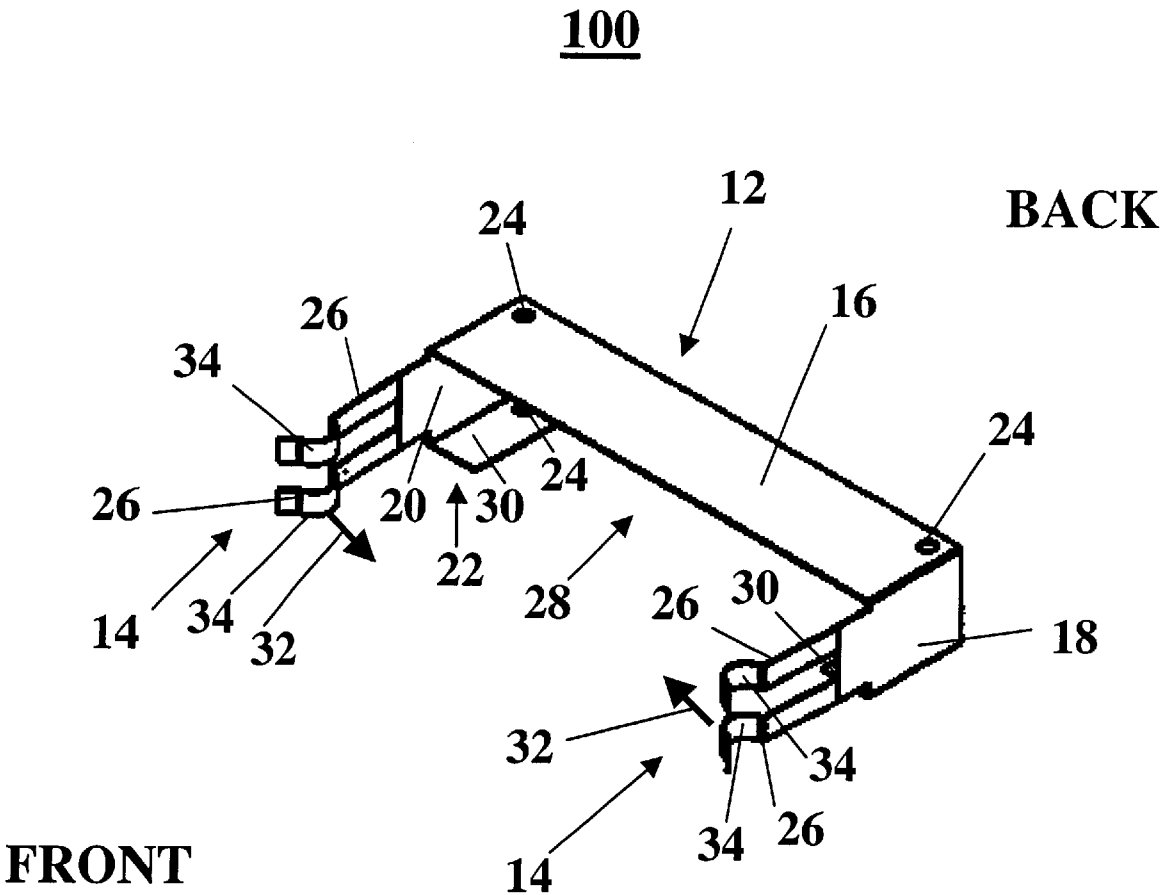
FIG. 1 is a perspective view of an exemplary electronic circuit protection device in accordance with an embodiment of the present invention.

FIG. 1 is a perspective view of an exemplary electronic circuit protection device 100 in accordance with an embodiment of the present invention. Circuit protection device 100 comprises a first receiving portion 12 and members 14. In one embodiment of the invention, members 14 are resilient members. The first receiving portion 12 comprises a top portion 16, a first side portion 18, a second side portion 20, and a bottom portion 22. The first receiving portion 12 forms a cavity 28. The first receiving portion 12 is shaped to approximately conform to the connector or circuit to be inserted into portion 12. In one embodiment of the invention, the first receiving portion 12 is approximately rectangular.

The bottom portion 22 of protection device 100 is shown having tabs 30. This configuration is exemplary. In an alternate embodiment of the invention, bottom portion 22 comprises a single portion, similar in shape to top portion 16, connected to side portions 18 and 20. Also envisioned, are various size tabs 30. For example, the tabs 30 may be longer, such that the facing ends of the tabs are closer together. Openings 24 are defined within top portion 16 and bottom portion 22. As explained in further detail herein, openings 24 may be used to facilitate coupling between device 100 and an electronic circuit/device, which is inserted into the cavity 28.

Device 100 also comprises a second receiving portion comprising members 14. Members 14 are connected to the side portions 18 and 20. The resilient member 14 may be coupled to side portions 18 and 20 by any appropriate means capable of providing electrical coupling, such as by solder, welded, an electrically conductive adhesive, and/or integrally formed with the side portions 18 and 20. The resiliency of members 14 is such that members 14 tend to exert a force in the direction of arrows 32, when a force in the direction opposite the direction of arrows 32 is exerted on member 14. Members 14 cooperate to clamp the edge a device/circuit (e.g., circuit card), which is inserted into device 100 between members 14, in place and ensure that the electrical coupling between the circuit card and the members 14 is not broken as a result of shock, vibration, or other physical movement. Members 14 are shown comprising two pairs of contact arms 26, each pair respectively connected to side portions 18 and 20. This configuration is exemplary. In alternate embodiments of the invention, the number of arms may be less than two per member, or more than two per member. In yet another embodiment of the invention, protection device 100 comprises a single member 14 coupled to either side portion 18 or side portion 20.

As shown in FIG. 1, members 14 comprise hooked portions 34. As described in further detail herein, hooked portions 34 facilitate electrical coupling between members 14 and an electronic circuit/device, which is inserted into device 100 between members 14. Alternate shaped contact arms 26 are envisioned, such as an approximately straight contact arms 26, and/or a contact arms 26 comprising semicircular shaped hook portions.

Figure 2:
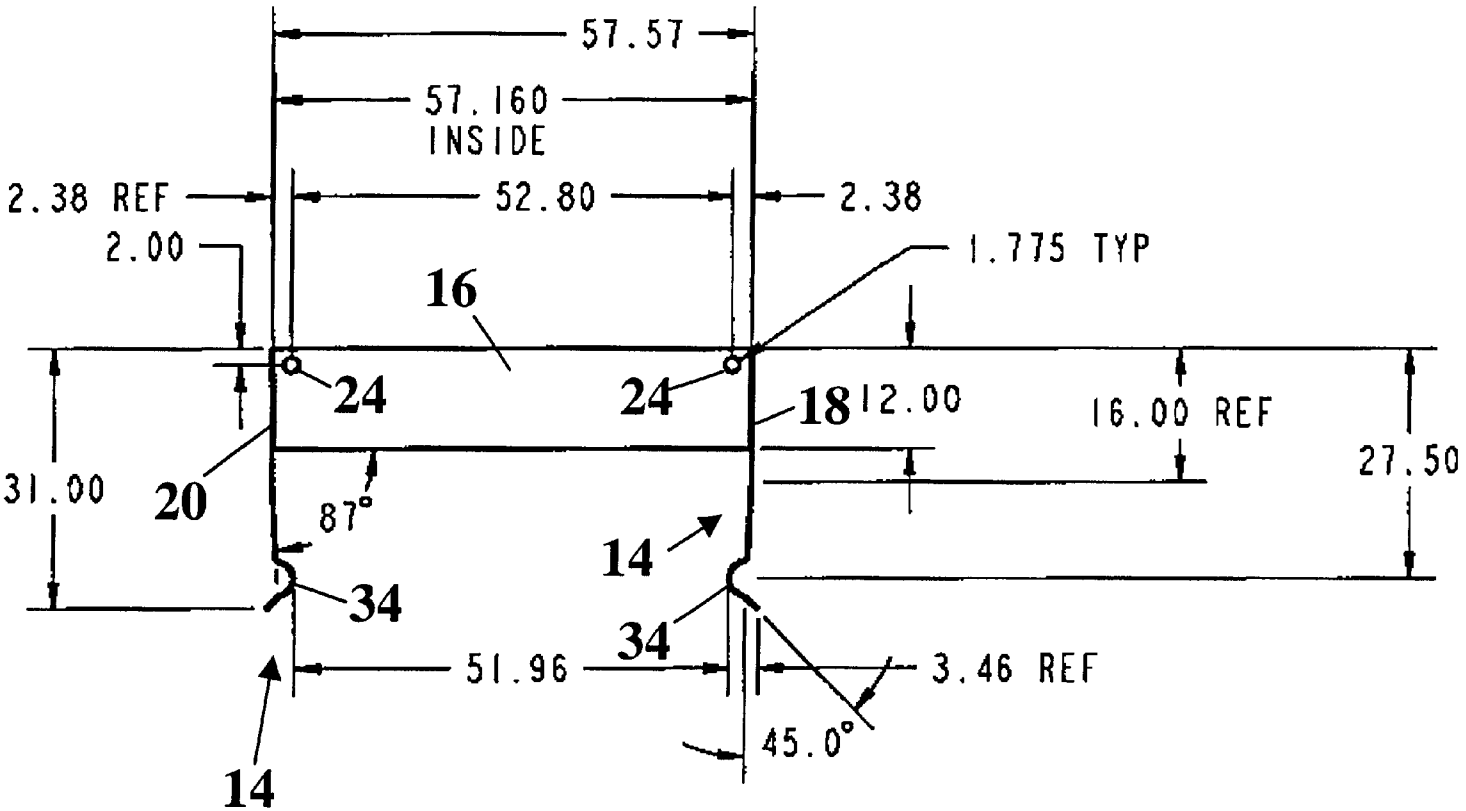
FIG. 2 is a top plan view of an exemplary electronic circuit protection device 100 in accordance with an embodiment of the present invention.

FIG. 2 is a top plan view of an exemplary electronic circuit protection device 100 in accordance with an embodiment of the present invention. All lineal dimensions in FIG. 2 are in millimeters (mm) and angular dimensions are in degrees. Dimensions are approximate and exemplary, however the dimensions shown for device 100 are compatible with the Personal Computer Memory Card International Association (PCMCIA) and Japan Electronic Industry Development Association (JEIDA) standards. PCMCIA and JEIDA are standards, which define, inter alia, an electronic device/circuit's physical design, computer socket (e.g., connector) design, electrical interface, and associated software. PCMCIA and JEIDA compatible electronic devices and circuits include memory cards, central processing unit boards of a computer processor, modems, sound cards, floppy disk controllers, hard drives, CD ROM and SCSI controllers, data acquisition circuits, and pagers, for example.

Referring again to FIG. 2, the inner dimension between members 14 is approximately 57.16 mm, which is the length (left to right) of top portion 16. The outer dimension between members 14 is approximately 57.57 mm. Thus, members 14 are each approximately 0.205 mm thick (equal thickness members). The diameter of openings 24 is approximately 1.775 mm, and the center of openings 24 are positioned approximately 2 mm forward of the rear edge of top portion 16 and approximately 2.38 mm inward from the side edges of top portion 16. Tabs 30 (not shown in FIG. 2) define openings 24 having the same diameter as openings 24 in top portion 16 and positioned directly below opening 24 in top portion 16.

The width of top portion 16 (from front to back) is approximately 12 mm. The total width (from front to back) of the forward edge of members 14 to the rear edge of top portion 16 is approximately 31 mm. Each member 14 forms an angle equal to approximately 87° with the forward edge of top portion 16. The inner dimension between hooked portions 34 is approximately 51.96 mm, and the elbow shape of each hooked portion 34 is terminated by an approximately straight portion forming an approximately 45° angle with member 14. The apex of each hooked portion 34 is positioned approximately 27.5 mm from the back edge of top portion 16. The dimension between the edge of the apex of each hooked portion 34 and the tip of the approximately straight portion of each hooked portion 34 is approximately 3.46 mm.

Figure 3:
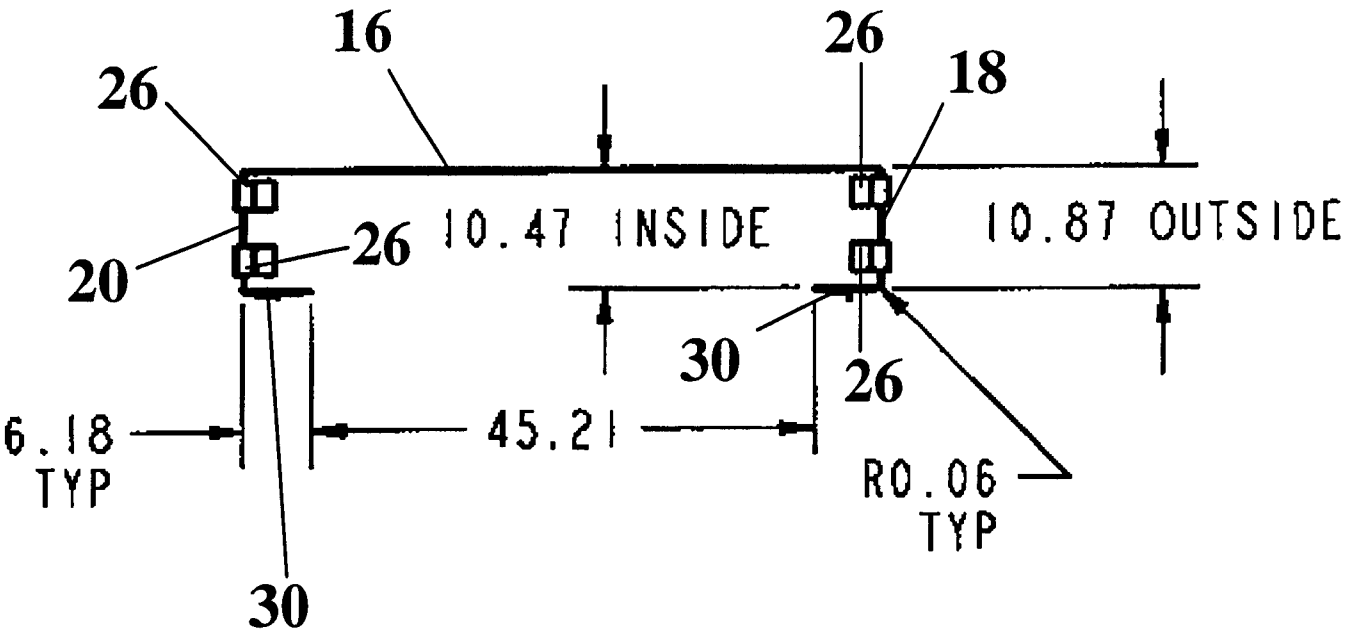
FIG. 3 is a front plan view of an electronic circuit protection device 100 in accordance with an exemplary embodiment of the present invention.

FIG. 3 is a front plan view of an electronic circuit protection device 100 in accordance with an exemplary embodiment of the present invention. All lineal dimensions in FIG. 2 are in millimeters (mm). The inner dimension and outer dimension between tabs 30 and top portion 16 are approximately 10.47 mm and approximately 10.87 mm, respectively. Thus, each of top portion 16 and tabs 30 is approximately 0.2 mm thick (assuming equal thickness). The dimension between the inner edges of tabs 30 is approximately 45.2 mm. Each of tabs 30 is approximately 6.18 mm long (left to right). The edges where side portions 18 and 20 each mate with tabs 30 are rounded, forming a surface having a radius of curvature equal to approximately 0.06 mm.

Figure 4:
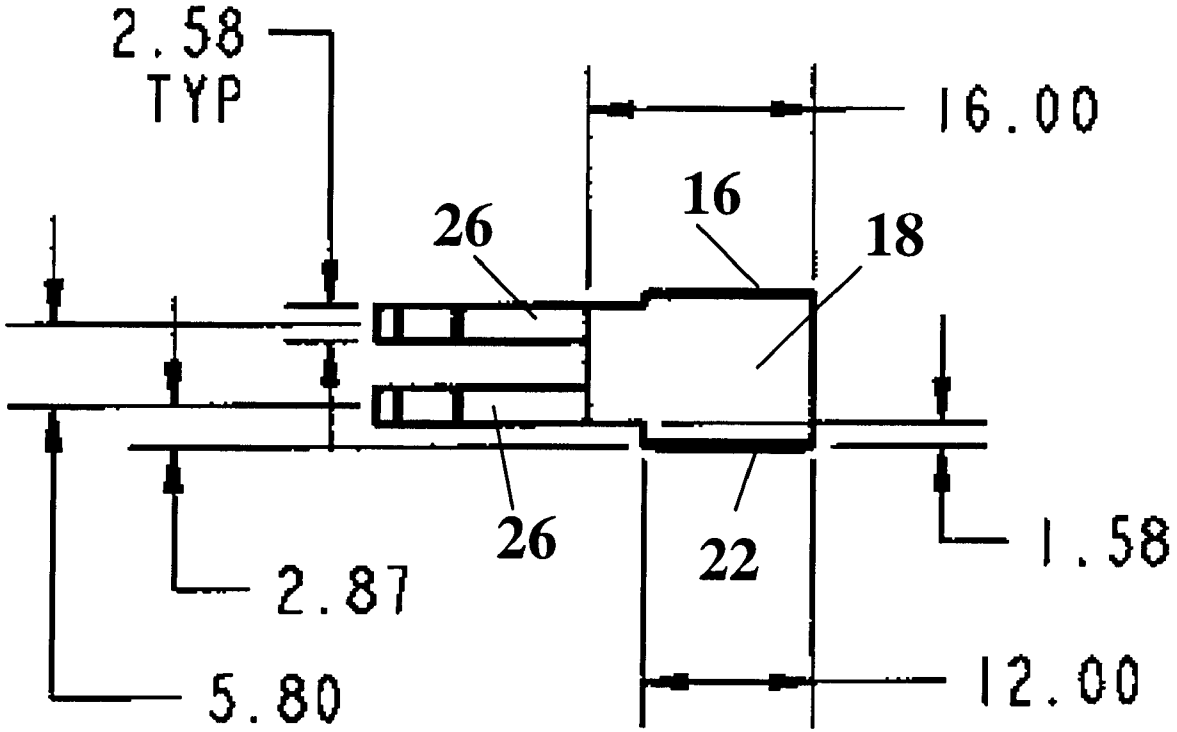
FIG. 4 is a side plan view of an electronic circuit protection device 100 in accordance with an exemplary embodiment of the present invention.

FIG. 4 is a side plan view of an electronic circuit protection device 100 in accordance with an exemplary embodiment of the present invention. All lineal dimensions in FIG. 2 are in millimeters (mm). A side view of device 100 from the perspective of side portion 18 facing front is shown in FIG. 4. The width of each of side portions 18 and 20 (side portion 20 not shown in FIG. 4) is approximately 16 mm (left to right in FIG. 4). The thickness of each of arms 26 is approximately 2.58 mm. The dimension between the centerline of each of arms 26, on the same side of device 100, is approximately 5.8 mm. The dimension between the centerline of the bottom arm 26 and the bottom edge of side 18 is approximately 1.58 mm. Although not shown in FIG. 4, the dimension between the centerline of the bottom arm 26 and the bottom edge of side 20 is also approximately 1.58 mm.

An electronic circuit protection device in accordance with the present invention provides protection from potentially harmful electrical voltages and/or currents resulting from phenomena such as electromagnetic interference (EMI), radio frequency interference (RFI), and/or electrostatic discharge (ESD), for example. Electrical charges may be developed on electronic circuits, such as integrated circuit (IC) cards, during handling of the cards (e.g., during manufacturing and individual use). When cards are inserted into an electronic apparatus (e.g., other electronic circuits, processors, personal computers) or a connector thereof, the current produced by the charges tends to flow to the electronic apparatus through the connecting terminals of the connector. Such charges may cause damage or result in failure of the electronic apparatus, the card, and/or components on the card/apparatus. An electronic circuit protection device in accordance with the present invention provides an electrically conductive path, which allows the potentially harmful current to bypass the circuit(s) being protected.

Figure 5:
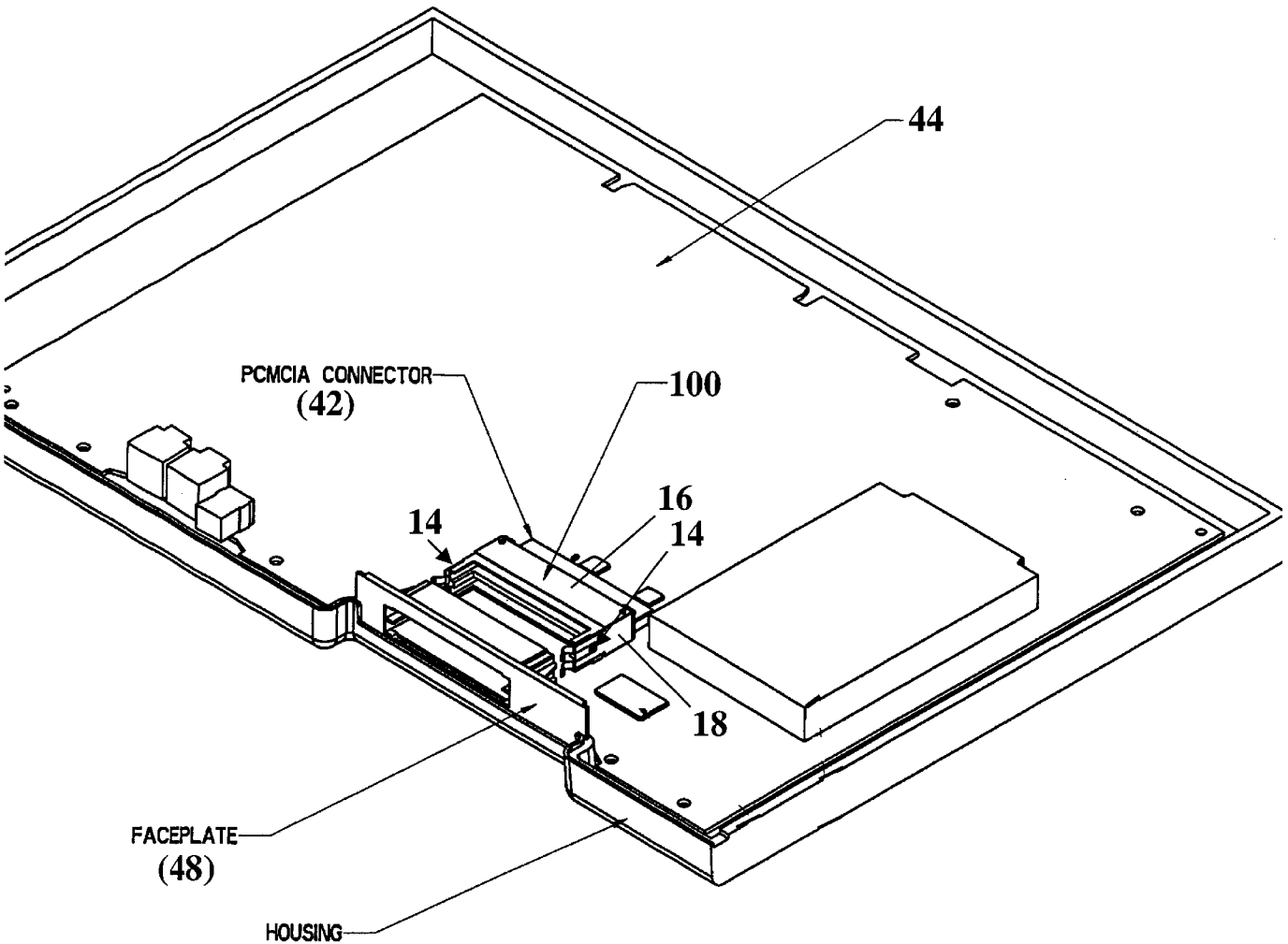
FIG. 5 is a perspective view of an electronic circuit coupled to an electronic discharge protection device in accordance with an exemplary embodiment of the present invention.

FIG. 5 is a perspective view of an electronic circuit coupled to an electronic discharge protection device 100 in accordance with an exemplary embodiment of the present invention. An electronic circuit, such as printed circuit board 44, is coupled to device 100 via connector 42. Connector 42 may be any type of connector, such as a PCMCIA or JEIDA compatible connector. PCMCIA and JEIDA compatible electronic device/circuits comprise connecting points positioned at predetermined locations or regions, which are electrically coupled to ground potential on the electronic PCMCIA and JEIDA compatible device/circuit. An electronic circuit protection device 100, in accordance with the present invention, is electrically coupled to at least one of these predetermined connecting points when an electronic circuit/device is inserted into the device 100. In one embodiment of the invention, sides 18 and 20 are electrically coupled to these predetermined connecting points on a first electronic device/circuit when the first electronic device/circuit is inserted into cavity 28, and members 14 are electrically coupled to these predetermined connecting points on a second electronic device/circuit when the second electronic device/circuit is inserted between members 14. In another embodiment of the invention, device 100 is electronically coupled to the predetermined connecting points on the first electronic device/circuit via openings 24. This electrical coupling between the predetermined connecting points and openings 24 is accomplished by a mechanical fastener, such as a screw, for example, fastened through the board 44, the device 100, and a PCMCIA header coupled to PCMCIA connector 42 (PCMCIA header not shown in FIG. 5). As shown in FIG. 1, device 100 comprises two contact arms 26 on each side of the device 100. Thus, each of the two contact arms 26 may contact a respective electronic circuit (electronic circuit not shown in FIGS. 1 and 5). The PCMCIA connector 42 comprises a single slot for receiving an electronic circuit (e.g., a circuit card). The PCMCIA header, comprises two slots for receiving two cards, and for coupling these cards to PCMCIA connector 42.

Referring again to FIG. 5 and FIG. 1, connector 42 is connected to the board 44 by any appropriate means know in the art, such as soldering, for example. The PCMCIA header and device 100 are mounted to board 44 by any appropriate fastening means, such as a screw from underneath board 44, for example. A PCMCIA compatible card (or cards) is inserted through cavity 28 from the front of device 100. In accordance with the PCMCIA standard, the predetermined connecting points of connector 42 are electrically coupled to ground of board 44. Thus, electronic protection device 100 is electrically coupled to ground potential of the circuit board 44, when connector 42 is inserted into device 100. During the user interface process, it is possible for static charges to develop on a PCMCIA card or a system user. Thus, a charge developed on a PCMCIA card or user is present during the insertion process through faceplate 48. Without device 100 coupled to connector 42, the static charges may tend to causes damaging current flow when the connector 42 is connected to faceplate 48. In one scenario, static charges cause an arc to be developed between the PCMCIA card and the board 44, which can also arc to the pin connectors of connector 42 (pins not shown in FIG. 5). However, device 100 provides a path for the potentially damaging current to flow to ground, thus bypassing electrical components on the board 44. This path is provided by members 14 making contact with the PCMCIA card(s), thus providing an electrically conductive path from the PCMCIA card(s); through members 14; through at least one of sides 18/20, and/or via openings 24 to ground of circuit board 44. Furthermore, members 14 provide protection against arcing, because members 14 make contact with the PCMCIA card(s) and circuit ground before allowing an arc to develop between the PCMCIA card(s) and other board components.

Once board 44, faceplate 48, and device 100 are assembled together, electronic circuit protection device 100 provides protection from potential damage from static charges developed on an electronic circuit/device, which is to be plugged into connector 42 through faceplate 48 (electronic circuit/device to be plugged in not shown in FIG. 5). If the circuit/device to be plugged into connector 42 (e.g., sound card, modem, disk drive controller, digital camera flash memory card, video game cartridge), comprises a developed static charge, this static charge will likely arc to device 100 during insertion. Electronic circuit protection device 100 provides an electrically conductive path via members 14, to ground of the board 44, thus bypassing electrical components on the board 44. EMI and RFI may be developed at any time, including during operation of the circuit board 44 (e.g., during the operation of circuit board 44, wherein circuit board 44 is a central processing unit of a personal computer). Thus, circuit protection device 100 provides protection during the operation of electronic circuit, such as a personal computer.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. An electronic circuit protection device comprising:

a first receiving portion capable of receiving a first connector, said first receiving portion being approximately conformably shaped to the first connector, wherein said first receiving portion is electrically coupled to the first connector when the first connector is inserted into said first receiving portion; and a second receiving portion capable of receiving a second connector, said second receiving portion being electrically coupled to the second connector when the second connector is inserted into said second receiving portion, wherein said electronic circuit protection device electronically couples the first connector to the second connector when the first connector and the second connector are inserted into said electronic circuit protection device, and wherein said second receiving portion comprises at least one resilient contact arm, wherein said at least one resilient contact arm is electrically coupled to the second connector when the second connector is inserted into said receiving portion.

2. The electronic circuit protection device in accordance with claim 1, wherein said first receiving portion is electrically coupled to the first connector at a contact region on the first connector when the first connector is inserted into said first receiving portion, the contact region being configured to be at ground potential.

3. The electronic circuit protection device in accordance with claim 1, wherein said first receiving portion is coupled to the first connector by at least one of a solder connection, a pressure fit, and a through hole connection.

4. The electronic circuit protection device in accordance with claim 1, wherein said first receiving portion is coupled to the first connector by a through hole connection including at least one opening in said first receiving portion for inserting a fastener through said opening and into the first connector.

5. The electronic circuit protection device in accordance with claim 1, wherein said first receiving portion is fixedly coupled to the first connector when the first connector is inserted into said first receiving portion.

6. The electronic circuit protection device in accordance with claim 1, wherein said electronic circuit protection device provides a ground potential for receiving an electrical charge stored on the first or second connector.

7. The electronic circuit protection device in accordance with claim 1, wherein the first connector comprises one of a PCMCIA compatible connector and a JEIDA compatible connector.

8. The electronic circuit protection device in accordance with claim 7, wherein the second connector comprises one of a PCMCIA compatible connector and a JEIDA compatible connector.

9. The electronic circuit protection device in accordance with claim 1, wherein said first and second receiving portions are approximately rectangular, and collectively include:

a top portion;

a bottom portion opposite said top portion;

a first side portion connected to said top portion and said bottom portion; and a second side portion, opposite said first side portion, said second side portion being connected to said top portion and said bottom portion, wherein said bottom portion includes:

a first tab connected to said first side portion; and a second tab connected to said second side portion, wherein said first and second tabs are approximately parallel to said top portion.

10. The electronic circuit protection device in accordance with claim 9, wherein said at least one resilient contact arm includes:

a first set of resilient contact arms electrically coupled to said first side portion; and a second set of resilient contact arms, opposite said first set, said second set being electrically coupled to said second side portion.

11. The electronic circuit protection device in accordance with claim 10, wherein said electronic circuit protection device receives connectors in compliance with at least one of a PCMCIA standard and a JEIDA standard.

12. The electronic circuit protection device in accordance with claim 1, wherein the first connector is configured to be coupled to one of a printed circuit board, a PCMCIA compatible electronic circuit, a JEIDA compatible electronic circuit, and an electronic module.

13. The electronic circuit protection device in accordance with claim 12, wherein the second connector is configured to be coupled to one of a printed circuit board, a PCMCIA compatible electronic circuit, a JEIDA compatible electronic circuit, and an electronic module.

14. An electronic circuit protection device comprising:

a first receiving portion capable of receiving a first connector, said first receiving portion being approximately conformably shaped to the first connector, wherein said first receiving portion is electrically coupled to the first connector when the first connector is inserted into said first receiving portion; and a second receiving portion capable of receiving a second connector, said second receiving portion being electrically coupled to the second connector when the second connector is inserted into said second receiving portion, wherein said electronic circuit protection device electronically couples the first connector to the second connector when the first connector and the second connector are inserted into said electronic circuit protection device, and wherein said first receiving portion is couple to the first connector by a through hole connection including at least one opening in said first receiving portion for inserting a fastener through said opening and into the first connector.

15. An electronic circuit protection device comprising:

a first receiving portion capable of receiving a first connector in the form of a PCMCIA compatible connector or a JEIDA compatible connector, said first receiving portion being approximately conformably shaped to the first connector, wherein said first receiving portion is electrically coupled to the first connector when the first connector is inserted into said first receiving portion, wherein said first receiving portion includes at least one resilient contact arm, wherein said at least one resilient contact arm is electrically coupled to the first connector when the first connector is inserted into said first receiving portion; and a second receiving portion capable of receiving a second connector in the form of a PCMCIA compatible connector or a JEIDA compatible connector, said second receiving portion being approximately conformably shaped to the second connector, wherein said second receiving portion is electrically coupled to the second connector when the second connector is inserted into said second receiving portion, wherein said second receiving portion includes at least one resilient contact arm, wherein said at least one resilient contact arm is electrically connected to the second connector when the second connector is inserted into said second receiving portion.

16. The electronic circuit protection device in accordance with claim 15, wherein said at least one resilient contact arm of said first receiving portion engages a side of the first connector when the first connector is inserted into said first receiving portion.

17. The electronic circuit protection device in accordance with claim 15, wherein said first and second receiving portions are collectively approximately rectangular in shape and collectively include:

a top portion;

a bottom portion opposite said top portion;

a first side portion connected to said top portion and said bottom portion; and a second side portion, opposite said first side portion, and connected to said top portion and said bottom portion, wherein said at least one resilient contact arm of said first receiving portion includes a first resilient contact arm electrically coupled to said first side portion and a second resilient contact arm electrically coupled to said second side portion, for engaging first and second sides of the first connector, when the first connector is inserted into said first receiving portion, and wherein said at least one resilient contact arm of said second receiving portion includes a third resilient contact arm electrically coupled to said first side portion and a fourth resilient contact arm electrically coupled to said second side portion, for engaging first and second sides of the second connector, when the second connector is inserted into said second receiving portion.

18. The electronic circuit protection device in accordance with claim 17, wherein said bottom portion includes first and second tabs for connection to a printed circuit board.

* * * * *